US007635308B2

(12) United States Patent
Merrill

(10) Patent No.: US 7,635,308 B2
(45) Date of Patent: Dec. 22, 2009

(54) GOLF SWING TRAINING AID

(75) Inventor: Michael T. Merrill, Nantucket, MA (US)

(73) Assignee: The Spirit Merchandising Group, Carrollton, TX (US)

( * ) Notice: Subject to any disclaimer, the term of this patent is extended or adjusted under 35 U.S.C. 154(b) by 0 days.

(21) Appl. No.: 11/572,385

(22) PCT Filed: Jul. 15, 2005

(86) PCT No.: PCT/US2005/025312

§ 371 (c)(1),
(2), (4) Date: Jan. 19, 2007

(87) PCT Pub. No.: WO2006/020140

PCT Pub. Date: Feb. 23, 2006

(65) Prior Publication Data

US 2008/0119299 A1 May 22, 2008

Related U.S. Application Data

(60) Provisional application No. 60/588,987, filed on Jul. 20, 2004.

(51) Int. Cl.
*A63B 69/36* (2006.01)

(52) U.S. Cl. ..... 473/276; 473/219; 473/409

(58) Field of Classification Search ..... 473/207, 473/212, 219, 227, 256, 266, 276, 409; 482/129
See application file for complete search history.

(56) References Cited

U.S. PATENT DOCUMENTS

| | | | | | |
|---|---|---|---|---|---|
| 1,973,240 | A * | 9/1934 | Proudfit et al. | ..... | 27/13 |
| 4,045,033 | A * | 8/1977 | Schuman | ..... | 473/266 |
| 5,203,567 | A * | 4/1993 | Erlinger et al. | ..... | 473/276 |
| 5,839,968 | A * | 11/1998 | Latella | ..... | 473/219 |
| 5,984,813 | A * | 11/1999 | Cinnella | ..... | 473/613 |
| 2004/0219988 | A1 * | 11/2004 | Park et al. | ..... | 473/256 |

* cited by examiner

*Primary Examiner*—Nini Legesse
(74) *Attorney, Agent, or Firm*—Salter & Michaelson

(57) ABSTRACT

The present invention is a method and apparatus for a golf swing training that assists a trainee or golfer in improving their golf swing. The apparatus of the present invention comprises a device designed to be supported between the forearms of the trainee or golfer during the golf swing. The dimensions of the device are selected so the device can be supported in relationship to the arms of trainee in the same configuration as the relationship of the arms during a natural and proper golf swing. By supporting the golf training apparatus between the forearms, the golf training apparatus induces the trainee or golfer to maintain the forearms, and importantly, the wrists, in a "quiet state" that produces a more effective golf swing.

21 Claims, 5 Drawing Sheets

GOLF SWING TRAINING AID

CROSS REFERENCE OF APPLICATION

This application incorporates by reference the International Patent Application No. PCT/US2005/025312, filed July 15, 2005, which claims priority to U.S. Patent Application No. 60/588,987, filed July 20, 2004.

BACKGROUND OF THE INVENTION

The present invention is a golf swing training aid and a method of use therefor. The present invention is both a method for improving a golf swing and an apparatus to be used during training to improve the golf swing.

Some golf training methods and apparatus appear to overcomplicate the functions of the golf swing and the preferred club positioning. For example, U.S. application Ser. No. 10/466,269 by Yoshimura discloses an elaborate golf stroke correcting device that comprises an arm device formed with five frames, a plurality of arm pads and a golf club fixing device for attaching a golf club to the stroke correcting device. Further, Yoshimura discloses the golf stroke correcting device has multiple functions including: (1) adjusting a distance between right and left arms; (2) adjusting a positional relation between right and left arms; (3) adjusting an angle in the arm device; (4) adjusting an angle formed by an arm device and a golf club fixing device; and (5) adjusting an angle formed by the arm device and the golf club.

As in Yoshimura discussed above, many background art golf swing training methods and apparatus depend upon use of a restraining device that physically limits the free range of movement of some part of the trainee's body. Such methods and apparatus offer some risk of injury since they often use some type rigid physical restraint (e.g., frames, arm pads) to impose a limit on some movement that is currently a part of the trainee's golf swing.

Alternatively, other golf training methods and apparatus typically underestimate the importance of consistent physical mechanics and how use of these mechanics can affect the desired golf swing. U.S. Pat. No. 5,839,968 by Latella discloses a club swinging training method and apparatus that uses pliable body spacer objects, such as balls of varying sizes, weights and pliability, which are placed between the limbs. In particular, Latella discloses the use of a medicine ball that is gripped between the elbows. More specifically, Latella discloses a method where the trainee "squeezes" a ball weighing between 0.4 and 0.5 kg with his elbows throughout the golf swing In some of the exercises which are described a golf club or a simulated club is actually moved as in a swing. However there is no indication that the training includes actually striking a golf ball. Further, Latella and other similar background art require the trainee to use muscles in one way during training (e.g., squeezing a ball between the trainee's elbows) and in a different way during an actual golf swing. The variability of the positioning of one's limbs and tensioning of one's muscles from training session to training session with such background art methods and apparatus can make it difficult to obtain consistent and repeatable improvement in a trainees golf swing.

Therefore, there is a need in the art for a method and apparatus for golf swing training that allows a trainee or golfer to strive for developing and maintaining an improved golf swing without requiring complex training apparatus and that provides consistent utilization of the muscles and positioning of the limbs during both golf training swings and actual golf swings. Such a golf swing training method and apparatus should be simple to use and preferably employ an inexpensive and portable device as the training apparatus.

SUMMARY OF THE INVENTION

The present invention is a method and apparatus for a golf swing training that assists a trainee or golfer in improving their golf swing. The apparatus of the present invention comprises a device designed to be supported between the forearms of the trainee or golfer during the golf swing. At least some, if not all of the practice swings using the apparatus and method of the invention includes actually striking a golf ball. The dimensions of the device are selected so the device can be supported in relationship to the arms of trainee in the same configuration as the relationship of the arms during a natural and proper golf swing. By supporting the golf training apparatus between the forearms, the golf training apparatus induces the trainee or golfer to maintain the forearms, and importantly, the wrists, in a "quiet state" that produces a more effective golf swing. That is, supporting the golf training apparatus between the forearms of the trainee or golfer makes it difficult or impossible for the trainee or golfer to: (1) snap the head into the ball; or (2) twist the club in an effort to contact the ball from below. Thus, using the golf training apparatus helps to improve the loft of the ball. By practicing with the device, the users "muscle memory" records the "feel" of the positioning and manipulation of the arms and wrists. This "muscle memory" assists the user when swinging the club without use of the device.

One embodiment of the invention is a golf swing training apparatus comprising: a device configured to include channels arranged to accept the user's forearms. The channels are located in different regions of the device to accept forearms of a trainee, wherein, the device is of a shape, color, size and weight such that the trainee naturally maintains the position of their limbs and muscles while engaged with the device during a golf swing. Preferably, a first color region and a second color region are located a surface of the device in different regions of the device. Preferably, a center line of the device is located between the forearm accepting channels of the device.

In another aspect, the present invention provides a method for improving a golf swing, comprising: positioning a golf training apparatus between a trainee's forearms; gripping a handle of a golf club such that a center line of the golf training apparatus is: positioned between the trainee's forearms, aligned with a center line of the trainee, and aligned with the handle of the golf club; swinging the golf club in a backward direction until only a first color region of the golf training apparatus is visible; and swinging the golf club in a forward direction until only a second color region of the golf training apparatus is visible.

BRIEF DESCRIPTION OF THE DRAWINGS

The invention can be described in greater detail with the aid of the following drawings.

DETAILED DESCRIPTION OF THE PREFERRED EMBODIMENT

The apparatus of the present invention comprises a part spherical or part near-spherical device. In two specific regions of the device the surface significantly departs from a spherical surface. In each of those regions the surface displays a channel for accepting the forearm of a trainee or a golfer. One form of the apparatus is constructed by taking a part spherical or part near-spherical blank and modifying it by removing portions of the blank or its surface to provide for two forearm accepting channels on different hemispheres of the blank. A different method of construction is to create a mold encompassing a volume which is generally spherical or part-spherical or near spherical but departs from that form in two distinct regions. In each of the regions the surface of the volume significantly departs from a spherical surface. In each region the surface of the volume displays a channel that is suitable for accepting a forearm of a trainee or golfer. The mold is then employed to create the apparatus by filling the mold with a material selected to solidify into the desired form.

A primary goal of the present invention is to simplify the process of practicing swinging a golf club at a golf ball without crowding and confusing the swing training with thoughts of the mechanics involved. Using the present invention, the required mechanics are mastered through a training regimen that repeats the swing over and over again until it becomes natural. Swinging a golf club based on positioning your limbs and tensioning your muscles in what has become natural through training provides results that are much better than when one attempts to swing a club while concentrating on the supposed mechanics of a golf swing. The present invention bridges the gap between mechanics and the natural feeling obtained through swing training and allows trainees or golfers to make strides in their skill level.

The present invention creates a natural and ideal relationship between the torso, the hands, wrists, forearms and the club as the club is moved through swing and into the impact area with the golf ball. This inter-relationship between the above-discussed components is the one constant goal of all low handicap and Golf Professionals. However, this inter-relationship is typically not evident in over 90% of all golfers in the mid to high handicap range. Most of these individuals are flatfooted with the club head leading through impact with a golf ball. The result is a golf swing that produces no distance, inconsistent club face angle, and topped or fat shots. The method and apparatus of the present invention takes the trainee's focus away from trying to affect the golf ball and places the focus squarely on the trainee's body and club working together and through the golf ball.

Figure 1:
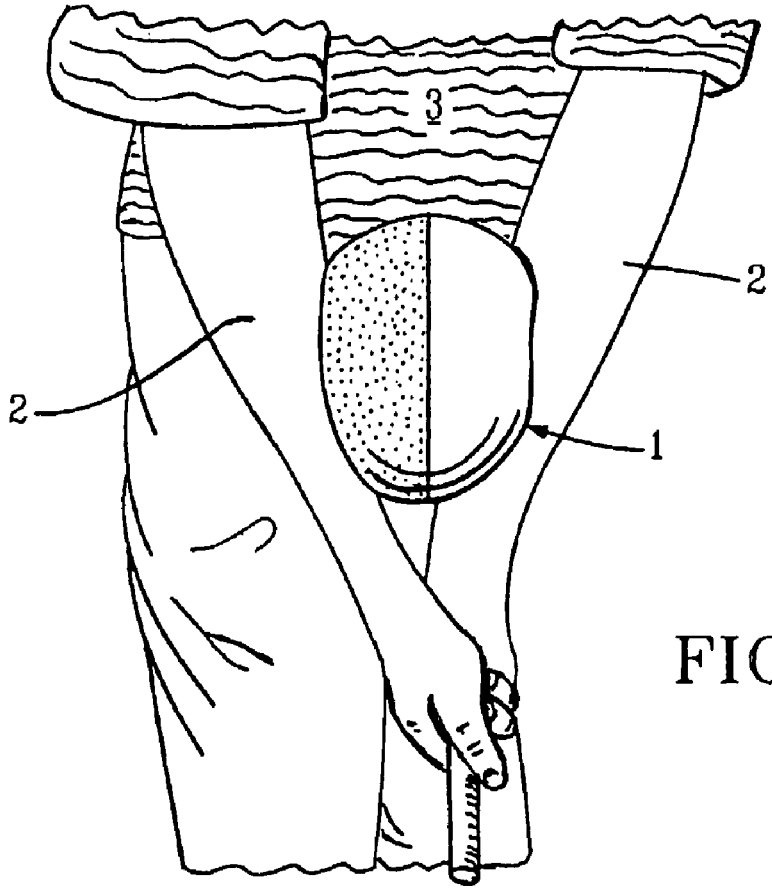
FIG. 1. illustrates one embodiment of a golf training apparatus in actual use accordance with the invention.

FIG. 1 shows the golf training apparatus 1 engaged with the forearms of a trainee or golfer 3 gripping a golf club. As shown in FIG. 1, the golf training apparatus 1 has a shape that is at least one of spherical, part spherical or part near-spherical. The shape of the golf training apparatus 1 includes channels to accept the forearms of the trainee or golfer 3 when engaging the golf training apparatus 1. The golf training apparatus 1 is fabricated with lightweight materials and preferably weighs in the range of about 0.17 kg (i.e., 6 ounces) to about 0.28 kg (i.e., 10 ounces) or one pound. The diameter of the golf training apparatus is in the range of about 10 cm to about 25 cm.

Non-limiting examples of such lightweight materials include, but are not limited to, foam rubber, plastic, paper and paper derivatives, which may be solid, hollow or substantially hollow. In one form of manufacture a suitable blank of the lightweight material is modified by cutting channels in the surface to accept a user's forearms. The original blank and the size and orientation of the channels are an appropriate shape, size and weight such that, when in use the trainee or golfer is not aware of maintaining the position of the golf training apparatus during a golf swing. In other words, merely maintaining the apparatus in the proper position requires the user to maintain his hands, wrists and forearms in the appropriate position for a proper golf swing.

Figure 2:
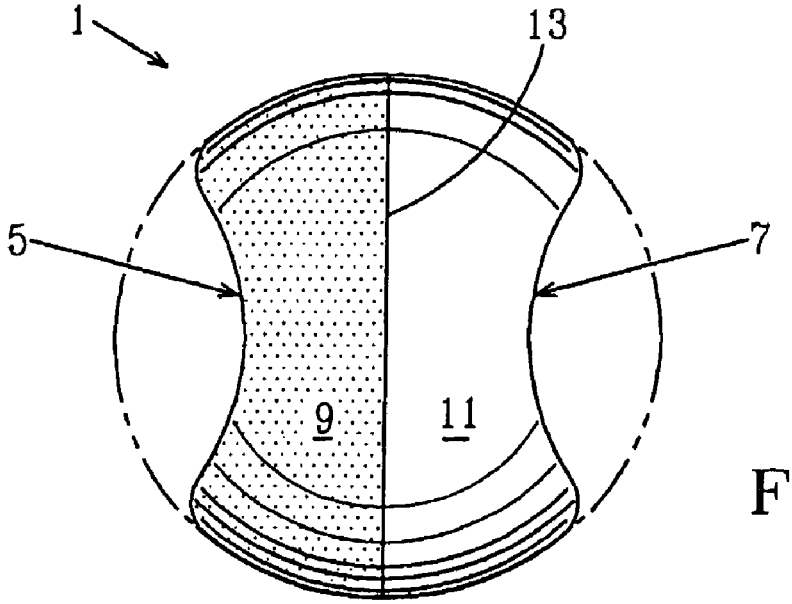
FIG. 2. is a view of the golf training apparatus showing two channels regions adapted for accepting the trainee's or golfer's forearms.

FIG. 2 shows how the shape of an initial blank has been modified to include forearm regions or channels 5, 7 for accepting the forearms of the trainee or golfer 3. In addition, FIG. 2 show that the golf training apparatus 1 further comprises two distinctive color regions 9, 11. The color regions 9, 11 are differentiated by the color of the surface of each region. For example, color region 9 may be darker in color than color region 11 or the reverse may be the case. A center line 13 between the two distinctive color regions 9, 11 will be located along the diameter of the spherical/non-spherical shaped golf training apparatus 1. Further, the center line of the golf training apparatus 1 is located between the forearm regions or channels 5, 7 of the golf training apparatus 1.

Moreover, the center line 13 of the golf training apparatus 1 is typically aligned with the handle of the golf club as the golf club is gripped by the trainee or golfer 3 and while the golf training apparatus 1 is engaged with the forearms of the trainee or golfer 3 as shown in FIG. 1. In addition, the center line of the golf training apparatus is aligned with the center line of a trainee's body. An example of the trainee or golfer 3 using the golf training apparatus 1 is illustrated in FIG. 3A to FIG. 3D.

Figure 3A:
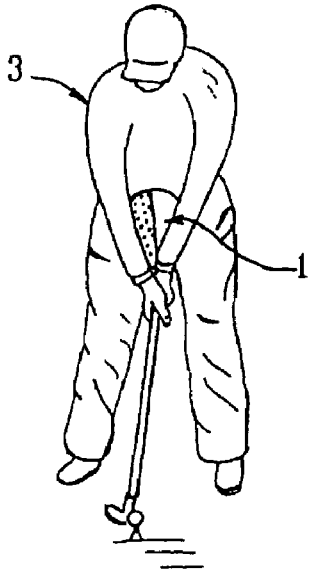
FIG. 3 is an illustration of the method of using the golf training apparatus.

As illustrated in FIG. 3A, the golf training apparatus 1 is located between the forearms of the trainee or golfer 3 as the golf club is gripped in preparation for a golf swing. In particular, positioning the golf training apparatus 1 between the forearms of the trainee or golfer 3 assists in "quieting" the wrist action of the trainee or golfer 3 during the impact of the golf club with the ball during a golf swing. Positioning the golf training apparatus 1 in this way forces the golfer to turn the body while impacting the golf ball instead of remaining on the back foot and snapping the wrists.

Figure 3B:
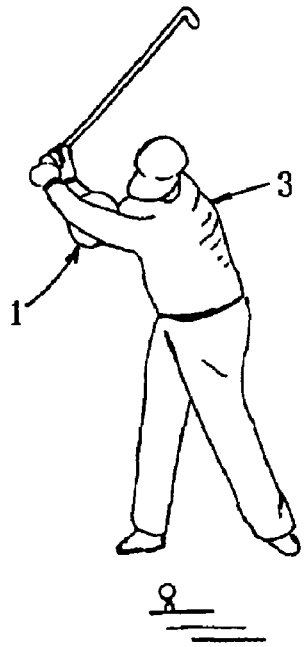
Figure 3C:
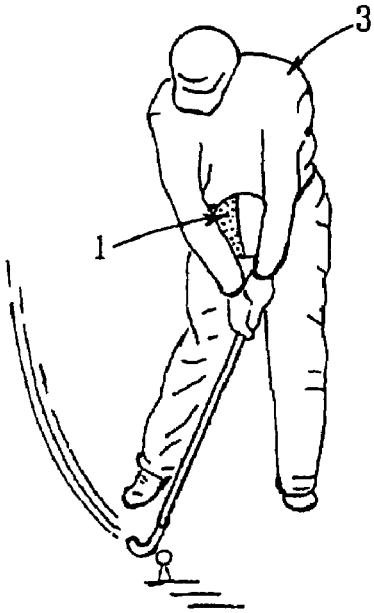
Figure 3D:
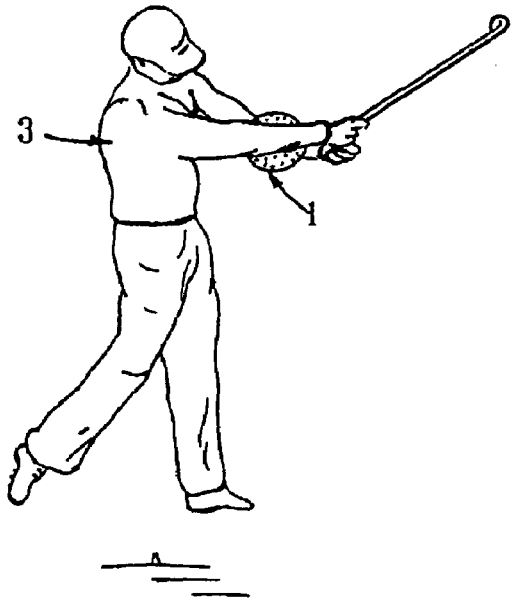

FIG. 3B to FIG. 3D further illustrate the use of the golf training apparatus. Note that from the vantage point of an observer for FIG. 3B through FIG. 3D, the appearance of the apparatus 1 changes through the different phases of the swing. More particularly, when initially addressing the ball (FIG. 3A), both regions 9 and 11 are clearly visible as indicated by the sight of both of the different colors of the regions 9 and 11. At the top of the swing (FIG. 3B), the trainee or golfer 3 has rotated both arms so that only one region 11 of the apparatus 1 is visible (i.e., only one of the two colored regions 9, 11 is visible). Just prior to contact with the golf ball (FIG. 3C), both regions 9, 11 are again visible; and as the stroke is completed (FIG. 3D) only one region 9 is visible. The foregoing describes the appearance presented to an observer during a properly executed swing. Deviations from this presentation serve as a clue to an improper swing. The trainee or golfer can also take advantage of the changing appearance of the apparatus at different times in a properly executed golf swing. More particularly, the trainee or golfer will also see both different colored regions of the apparatus as the ball is addressed (FIG. 3A). At the top of the backswing (FIG. 3B) and at the completion of the stroke (3D) where the observer should only one colored region, the trainee or golfer should see both.

Figure 4:
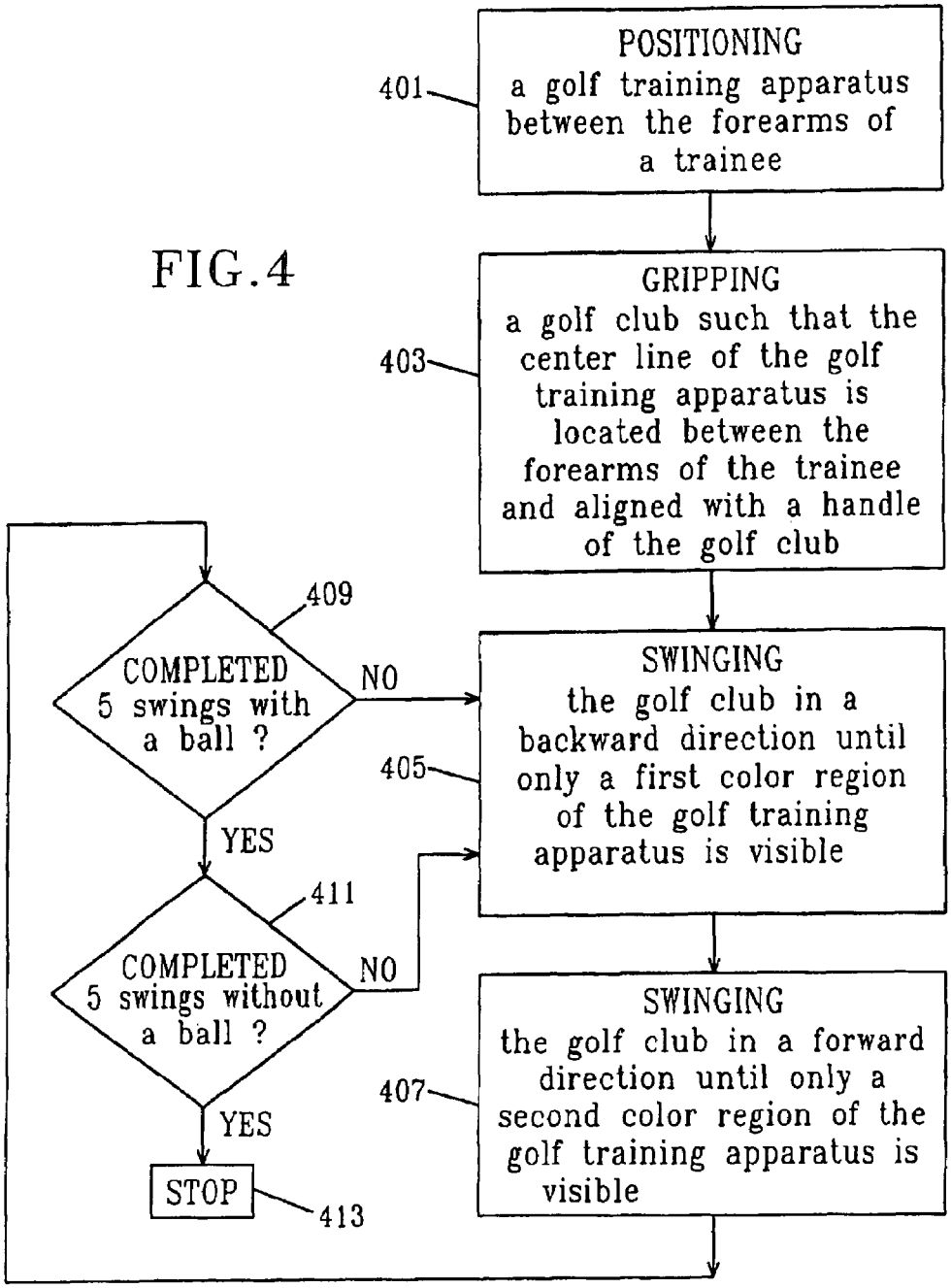
FIG. 4 is a flow diagram of the method of the present invention.

FIG. 4 shows a flow diagram of a method of using the golf training apparatus 1 for improving a golf swing. As indicated in FIG. 4, step 401 of the method is positioning a golf training apparatus between the forearms of a trainee. Step 403 involves gripping a handle of a golf club such that the axis or center line of the golf training apparatus is located between the forearms of the trainee and aligned with the axis or handle of the golf club. Step 401 and Step 403 are illustrated in FIG. 3A. Swinging the golf club in a backward direction until only a first color region of the golf training apparatus is visible to an observer is performed in Step 405. Step 405 is illustrated in FIG. 3B. Step 407, as indicated in FIG. 4 of the method flow diagram, involves swinging the golf club in a forward direction until the swing/stroke is completed and only a second color region of the golf training apparatus is visible to the observer. Step 407 is illustrated in FIG. 3D. Moreover, in one embodiment, the method of improving a golf swing includes all the steps leading up to swinging the golf club in the forward direction at least 5 times with a golf ball and at least 5 times without the golf ball as shown in Step 409 and Step 411, respectively, of FIG. 4. The method ends when at least 5 swings are completed with and without a golf ball, as shown in Step 413.

Figure 5:
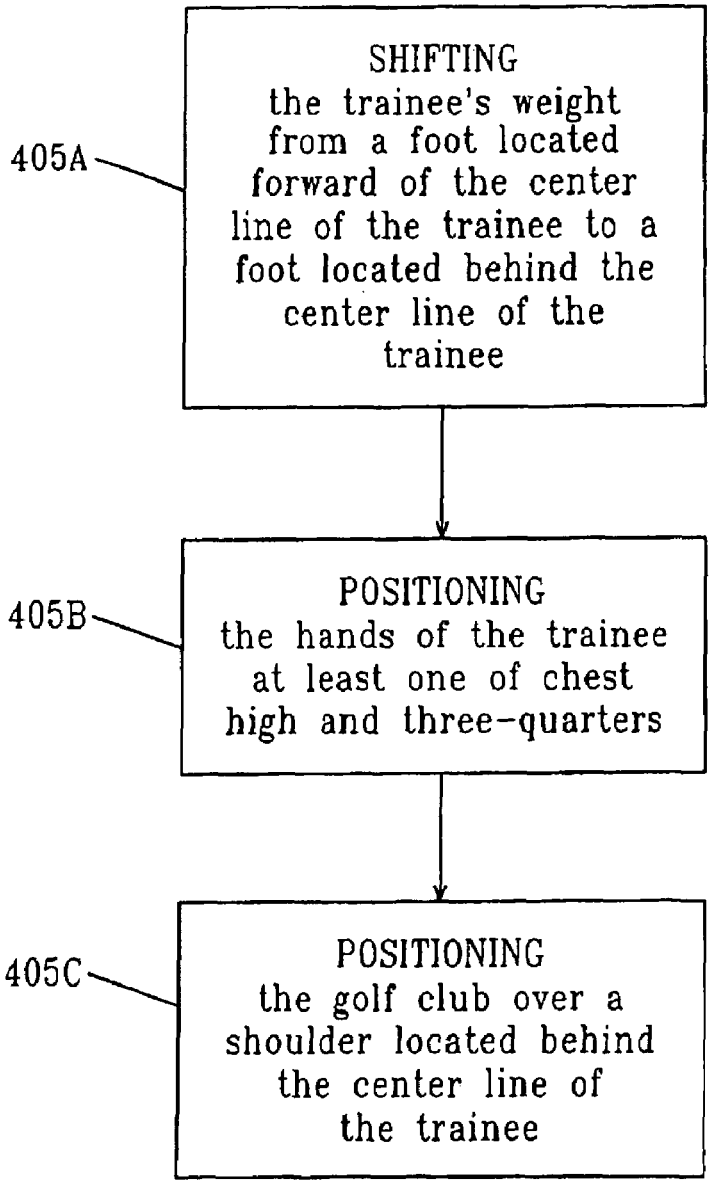
FIG. 5 is a flow diagram of the step of swinging a golf club in the backward direction in the method of the present invention.

Swinging the golf club in the backward direction, as shown in Step 405 of FIG. 4, further comprises the steps shown in FIG. 5. Step 405A of FIG. 5 is shifting the trainee's weight from a foot located forward of the center line of the trainee to a foot located behind the center line of the trainee. In addition, Step 405B of FIG. 5 comprises positioning the hands of the trainee at least one of chest high and three-quarters. Moreover, Step 405C comprises positioning the golf club over a shoulder located behind the center line of the trainee. Step 405C is illustrated in FIG. 3B.

Figure 6:
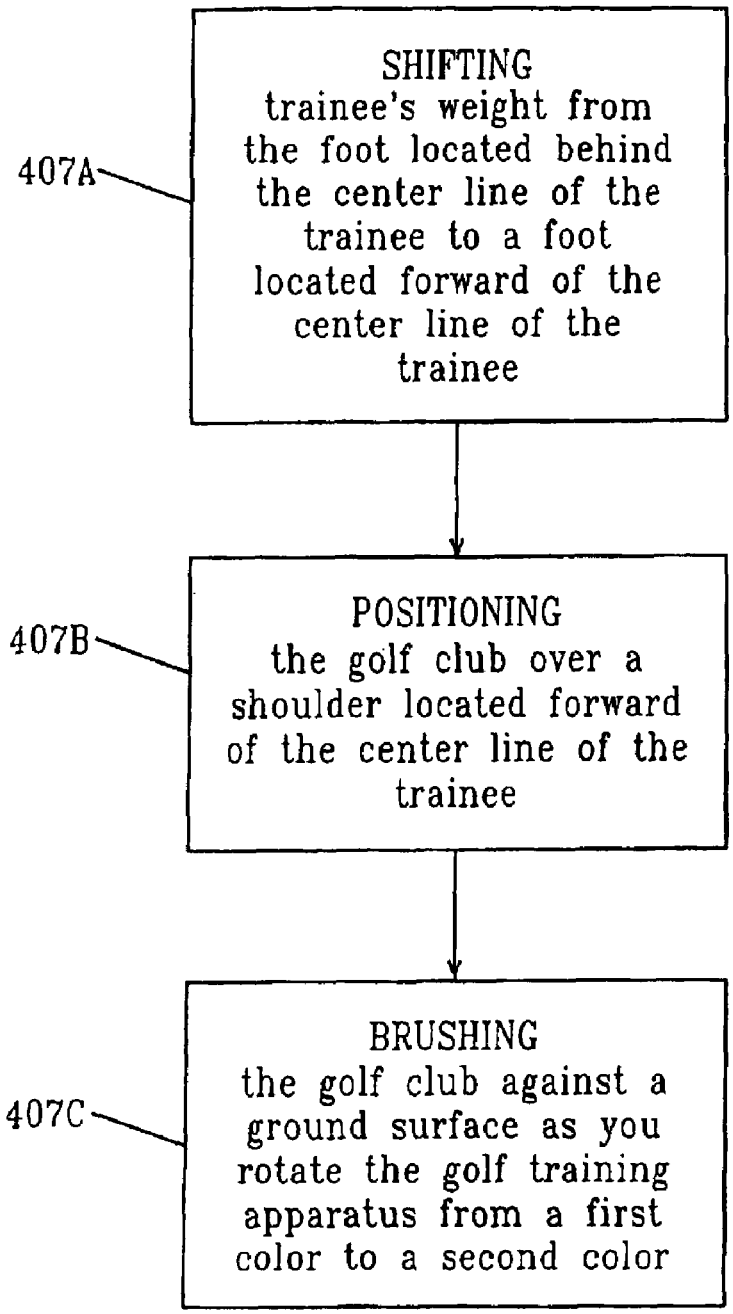
FIG. 6 is a flow diagram of the step of swinging a golf club in the forward direction in the method of the present invention.

Swinging the golf club in the forward direction, as shown in Step 407, further comprises the steps shown in FIG. 6. Step 407A of FIG. 6 is shifting trainee's weight from the foot located behind the center line of the trainee to a foot located forward of the center line of the trainee. In addition, Step 407B of FIG. 6 comprises positioning the golf club over a shoulder located forward of the center line of the trainee. Further, Step 407C comprises brushing the golf club against a ground surface as you rotate the golf training apparatus from a first color to a second color. Step 407C is illustrated in FIG. 3C.

By using the method of the present invention, as discussed above, a trainee learns to rotate their forearms properly by swinging the golf club first in a backward and then a forward direction and by turning the golf training apparatus 1 such that:

(1) only a first color region 9, 11 of the golf training apparatus 1 is visible to an outside observer while swinging in the backward direction; and (2) as the swing is completed in the forward direction, only a second color region 11, 9 of the golf training apparatus 1 is visible to the outside observer.

1. That is, by making the two color regions 9, 11 of the present invention distinctive, it is readily apparent to the outside observer whether on not the trainee is properly executing a golf swing upon impact.

The foregoing description illustrates and describes the present invention. Additionally, the disclosure shows and describes only the preferred embodiments of the invention, but as mentioned above, it is to be understood that the invention is capable of use in various other combinations, modifications, and environments and is capable of changes or modifications within the scope of the inventive concept as expressed herein, commensurate with the above teachings and/or skill or knowledge of the relevant art. The embodiments described hereinabove are further intended to explain best modes known of practicing the invention and to enable others skilled in the art to utilize the present invention in such or other embodiments and with the various modifications required by the particular applications or uses of the invention. Accordingly, the description is not intended to limit the invention to the form or application disclosed herein. Also, it is intended that the appended claims be construed to include alternative embodiments.

What is claimed is:

1. A golf swing training aid that is to be supported between the forearms of a golfer so as to assist the golfer with the swing of a golf club, said golf swing training aid comprising:

a light weight three dimensional partially spherical member that has opposed side surfaces that are provided with opposed respective forearm accepting channels;

said opposed forearm accepting channels being symmetrically located relative to a center plane that extends across the three dimensional member;

said opposed forearm accepting channels comprising opposed concave channels of substantially equal curvature and disposed in the opposed side surfaces of the light weight three dimensional member;

wherein the center plane separates the thee dimensional member into opposed first and second surface regions including respective and distinctive first and second color regions, said opposed forearm accepting concave channels for receiving respective forearms of the golfer so as to properly position the forearms throughout the swing of the golf club; wherein the golf club is swung in a backward direction until only the first color region of the golf swing training aid is visible, and wherein the golf club is swung in a forward direction until only the second color region of the golf swing training aid is visible.

2. The golf swing training aid of claim 1 wherein the three dimensional member has a diameter in a range of about 10 cm to about 25 cm.

3. The golf swing training aid of claim 1 wherein the three dimensional member is made from at least one of foam rubber, plastic, paper and paper derivatives.

4. The golf swing training aid of claim 1 wherein the three dimensional member is at least one of solid, hollow and substantially hollow construction.

5. The golf swing training aid of claim 1 wherein the three dimensional member weighs in a range of about 0.17 kg (i.e., 6 ounces) to about 0.28 kg (i.e., 10 ounces).

6. The golf swing training aid of claim 1 wherein the light weight three dimensional member is held between the forearms only by pressure applied at the forearms.

7. The golf swing training aid of claim 6 wherein the light weight three dimensional member is absent any straps for securing the member to the forearms.

8. The golf swing training aid of claim 1 wherein swinging the golf club includes swinging in a backward direction that is terminated when substantially only the first surface region is visible to an observer and wherein swinging in a forward direction is terminated when substantially only the second surface region is visible to the observer, so that the golf trainee learns from the observer how to rotate the forearms properly.

9. A method of having an observer assist a golf trainee with the swing of a golf club, using a golf swing training aid that is made of a light weight three dimensional member that has opposed side surfaces provided with opposed respective forearm accepting channels that are concave and symmetrically located relative to a center plane that extends across the three dimensional member and separates the three dimensional member into opposed first and second surface regions of respective different discernable types, said opposed forearm accepting concave channels for receiving respective forearms of the trainee so as to properly position the forearms throughout the swing of the golf club, said method comprising:

positioning the golf swing training aid between the forearms of the trainee as the golf club is grasped by the trainee;

initially gripping the golf club such that the center plane of the golf training apparatus is aligned with a center line of the trainee, as well as with a shaft of the golf club;

swinging the golf club in a backward direction; and swinging the golf club in a forward direction until the swing is completed;

wherein the golf club is swung in a backward direction until only the first color region of the golf swing training aid is visible, and wherein the golf club is swung in a forward direction until only the second color region of the golf swing training aid is visible.

10. The method of claim 9, wherein swinging the golf club in the backward direction further comprises shifting the trainee's weight from a foot located forward of the center line of the trainee to a foot located behind the center line of the trainee.

11. The method of claim 10, wherein swinging the golf club in the forward direction further comprises shifting trainee's weight from the foot located behind the center line of the trainee to a foot located forward of the center line of the trainee.

12. The method of claim 11, wherein swinging the golf club in the forward direction is performed at least 5 times with a golf ball.

13. The method of claim 9, wherein swinging the club in the backward direction further comprises swinging the club in the backward direction until the hands of the trainee are at least chest high.

14. The method of claim 13, wherein swinging the golf club in the forward direction positions the golf club over a shoulder located forward of the center line of the trainee.

15. The method of claim 14, wherein swinging the golf club in the forward direction is performed at least 5 times without a golf ball.

16. The method of claim 9, wherein swinging the club in the backward direction further comprises positioning the golf club over a shoulder located behind the center line of the trainee.

17. The method of claim 16, wherein swinging the golf club in a forward direction further comprises brushing the golf club against a ground surface while the golfer observes the golf swing training aid changing from a first color to a second color.

18. The method of claim 9 wherein, when the swing of the golf club in the backward direction is completed, the trainee sees both type regions.

19. The method of claim 9 wherein, when the swing of the golf club in the forward direction is completed, the trainee sees both type regions.

20. The method of claim 18 wherein, when the swing of the golf club in the forward direction is completed, the trainee sees both type regions.

21. The method of claim 9 wherein the light weight three dimensional member is held between the forearms only by pressure applied at the forearms.

* * * * *